United States Patent [19]

Boyarina et al.

[11] 4,428,856

[45] Jan. 31, 1984

[54] NON-EVAPORABLE GETTER

[76] Inventors: Maya F. Boyarina, ulitsa Trefoleva, 15, kv. 92; Vladimir G. Vildgrube, Svetla novsky prospekt, 44, korpus 2, kv. 144; Jury S. Sergeev, prospekt Morisa Toreza, 30, kv. 24, all of Leningrad, U.S.S.R.

[21] Appl. No.: 428,919

[22] Filed: Sep. 30, 1982

[51] Int. Cl.[3] ..... H01J 7/18; H01K 1/56

[52] U.S. Cl. ..... 252/181.1; 252/181.6; 75/230

[58] Field of Search ..... 252/181.1, 181.6; 75/230

[56] References Cited

U.S. PATENT DOCUMENTS

| | | | |
|---|---|---|---|
| 2,776,886 | 1/1957 | Kelly, Jr. et al. | 252/181.6 |
| 2,855,368 | 10/1958 | Perdijk, Jr. et al. | 252/181.6 |
| 3,627,521 | 12/1971 | Vordahl | 252/181.6 |

FOREIGN PATENT DOCUMENTS

| | | | |
|---|---|---|---|
| 670692 | 9/1963 | Canada | 252/181.6 |
| 336719 | 1/1972 | U.S.S.R. | 252/181.6 |
| 640685 | 12/1978 | U.S.S.R. | 252/181.6 |
| 693465 | 10/1979 | U.S.S.R. | 252/181.6 |

*Primary Examiner*—Brooks H. Hunt

*Attorney, Agent, or Firm*—Burgess, Ryan & Wayne

[57] ABSTRACT

Disclosed is a non-evaporable getter containing titanium, a refractory metal selected from Groups V and VI of the Periodic system with a melting temperature of no less than 2500° C. and titanium hydride, the ratio of the components taken in percent by weight, being as follows:

titanium: 50 to 98
refractory metal: 1.5 to 30
titanium hydride: 0.5 to 20.

2 Claims, No Drawings

NON-EVAPORABLE GETTER

FIELD OF THE INVENTION

The present invention resides in general in facilities for producing and/or sustaining a desired degree of vacuum by gettering, and more specifically is concerned with non-evaporable getters.

The invention may find a variety of applications in mechanical engineering, instrument engineering and radio engineering.

The invention can most advantageously be used in the electronic industry, in particular in gas-discharge, semiconductor and electronic devices.

BACKGROUND OF THE INVENTION

The present state-of-the art technology is known to make extensive use of evaporable getters based on alkaline-earth metals, such as barium, calcium, strontium.

The getters of the above type feature a fairly small sorption capacity margin due to the insignificant amounts of active metal included in their composition.

The use of the evaporable getters causes electronic devices to develop such defects as leakages, spurious capacitances and high-frequency losses, which results from the spraying of the vaporized metal onto undesired areas of the device. Furthermore, an inadequate degree of mechanical strength exhibited by the residue of metal evaporation causes the devices to develop such objectionable phenomena as sparking, break-downs and short-circuits brought about by the presence of extraneous particles from the getter.

The evaporable getters offer a narrow range of operating temperatures (from 20° to 200° C.), which considerably confines their field of application.

In order to produce a metal mirror with required sorption and mechanical properties it is necessary to meet a variety of different conditions, such as evaporation temperatures, distance between the getter and the surface on which the vaporized metal should condense, gaseous atmosphere in the device, amounts of the vaporized metal and so forth.

To a considerably larger degree today's technology requirements are satisfied with the advent of getters of a new type, i.e. the porous non-evaporable getters differing essentially from the evaporable getters in the mechanism of gas bonding which takes place due to the diffusion of gases into the metal and the formation of solid solutions. This results in fairly high sorption rates and large porous getter sorption capacities.

The non-evaporable getters may be located at any spot of the device and in any amount inasmuch as this is not accompanied by negative phenomena in the device owing to the getters as is often the case whenever the spray getters are involved.

The getters currently employed in the devices of various classes and designations are expected to display high sorption and mechanical properties over a broad range of temperatures.

In particular, known is a non-evaporable getter representing a sintered mixture of a zirconium-aluminum alloy and zirconium powder (see U.S.S.R. Pat. No. 640685).

The above non-evaporable getter features the highest sorption properties at a temperature of about 400° C.

However, beyond this temperature range, as stated in the Specification, the sorption properties of the getter are deteriorating.

The manufacturing process for the non-evaporable getter under consideration is characterized by increased explosion and fire hazards which are engendered by the presence of zirconium in the composition.

The non-evaporable getter of the above-specified composition suffers from an inadequate degree of mechanical strength due to its insufficient compressibility brought about by the presence of the alloy in the composition thereof. As a consequence, the device may eventually develop such severe defects as sparking, break-downs and short circuits caused by the presence of extraneous particles.

A decreased level of explosion and fire hazards, as compared to the foregoing nonspray getter, is exhibited by a non-evaporable getter containing titanium and an alloy of zirconium and vanadium (see U.S.S.R. Author's Certificate No. 693456).

A decrease in the level of explosion and fire hazards is achieved by reducing the content of zirconium in the composition of the getter and by using zirconium in the form of an alloy.

Sorption properties of this getter meet all the requirements at temperatures up to 800° C.

At temperatures in excess of 800° C. the titanium is recrystallized and the physical and chemical properties of the getter are changed resulting in a decrease in its sorption properties.

Furthermore, due to the presence of zirconium in the composition of the non-evaporable getter some of the stages of its manufacturing process still do not exclude potential explosion and fire hazards.

The non-evaporable getter of the above composition also suffers from an inadequate degree of mechanical strength due to its insufficient compressibility resulting from the presence of the alloy in the getter composition and, consequently, may cause the devices to develop such defects as sparking and break-downs.

By far the better sorption properties at temperatures in excess of 800° C. are displayed by a non-evaporable getter containing titanium, zirconium and tantalum, i.e. a refractory metal belonging to Group V of the Periodic System of elements (see U.S.S.R. Author's Certificate No. 336719).

An increase in the upper temperature limit, at which the getter maintains its high sorption properties, is ensured owing to the introduction of a refractory metal into its composition, in particular tantalum. Tantalum being distributed uniformly among the active particles of the getter prevents their fusion during the process of sintering and at the same time contributes to an increase of the porosity and of the active surface of the non-evaporable getter. As a consequence, the getter preserves its high sorption properties at higher temperature values.

However, as was found, the sorption and mechanical properties of the above getter do not fully meet the requirements currently imposed on the getters for use in the electronic devices, such as the increased reliability and longevity requirements, in particular in terms of the sorption of different gases at low temperatures (20° to 500° C.) and the resistance to vibration effects at frequencies in excess of 1000 hz.

Moreover, the production operations associated with the manufacture of the non-evaporable getters of the above composition also involve explosion and fire hazards, which results from the presence of zirconium in the composition.

SUMMARY OF THE INVENTION

A primary object of the present invention is to provide a non-evaporable getter featuring improved sorption properties over a wide range of temperatures.

Another object of the present invention is to provide a non-evaporable getter featuring high mechanical properties.

Still another object of the present invention is to provide an explosion-proof non-evaporable getter.

Still another object of the present invention is to provide a non-evaporable getter featuring a decreased level of fire hazards.

With these and other objects in view, there is provided a non-evaporable getter containing titanium and a refractory metal selected from Group V and VI of the Periodic System of elements with a melting temperature of no less than 2500° C., which getter, according to the invention, further contains titanium hydride, the ratio of the components taken in percent by weight being as follows:

titanium: 50 to 98
refractory metal: 1.5 to 30
titanium hydride: 0.5 to 20.

The presence of titanium hydride in the composition of the non-evaporable getter enables to improve the getter's sorption and mechanical properties inasmuch as while it is being heated the oxide films being present on the surface are reduced due to the decomposition of titanium hydride accompanied by the liberation of atomic hydrogen possessing high reduction properties. As a consequence, the cleaning of the surface of the active particles, i.e. their activation, is ensured, which is attended simultaneously with the process of sintering in the areas of contact.

Furthermore, by excluding the explosive and firehazardous component, i.e. zirconium, from the composition of the getter there is completely removed the possibility of explosion and considerably reduced the possibility of fire in all of the stages of its manufacturing process.

On condition that titanium hydride is included in the composition of the non-evaporable getter in amounts less than 0.5 wt. %, the sorption and mechanical properties of the getter tend to decline as the amount of evolving atomic hydrogen is insufficient for the reduction of oxide films. The presence of titanium hydride in amounts greater than 20 wt. % leads to an increase in the release of gas, a more lengthy process for the treatment of the getter and, consequently, to a decrease in its sorption properties as a result of "poisoning" by the gases.

The presence of titanium in the composition of the non-evaporable getter in amounts less than 50 wt. % results in a decrease in its sorption properties, while an increase in the amount of titanium more than 98 wt. % leads to the reduction of its porosity and, consequently, sorption properties, as well as to a decline in the maximum permissible operating temperature of the getter at the expense of a decrease in the amount of the refractory component.

As the refractory metal in the composition of the non-evaporable getter described may serve such metals belonging to Group V and VI of the Period System of elements with a melting temperature of at least 2500° C. as tungsten, molybdenum, niobium, tantalum. When introducing any of the foregoing metals or their mixtures into the composition of the non-evaporable getter the results are similar.

The presence of the refractory metal in the composition of the non-evaporable getter in amounts less than 1.5 wt. % in the process of sintering at elevated temperatures (higher than 800° C.) results in that the particles are fused and, consequently, a decrease in the porosity and in the active surface follows, which leads to a decline in the sorption properties of the getter.

With the content of the refractory metal in the composition of the non-evaporable getter in amounts greater than 30 wt. % also takes place a decrease in the sorption properties of the getter at the expense of an extreme increase in the amount of the inactive component.

It is expedient that the composition of the non-evaporable getter further include aluminum with the following ratio of the components taken in percent by weight:

titanium: 50 to 93
refractory metal: 1.5 to 20
titanium hydride: 0.5 to 20
aluminum: 5 to 20.

The incorporation of aluminum in the composition ensures an increase in the sorption properties of the non-evaporable getter and an expansion in the constructional and technological possibilities of the composition described, namely, it allows to improve the compressibility of the powder mixture and provides the obtention of mechanically durable constructions in the form of pellets embedded in holders of various designs by means of increasing the geometrical dimensions of the getters in the sintering process. The improved compressibility of the composition results from the interaction of heterogenous particles with a different structure of the surface, and improvement in the physical and chemical properties of the getter due to the formation of the intermetallic compounds of the components of the getter with aluminum.

The improved sorption properties of the proposed non-evaporable getter also results from an increase in its porosity determined by the partial evaporization of aluminum in the process of the thermal treatment of the getter.

With the content of aluminum in the composition of the non-evaporable getter in amounts less than 5 wt. % the uniformity of its action on the mechanical, physical and chemical properties of the getter fails to be provided.

An increase in the amount of aluminum greater than 20 wt. % brings about the deterioration of the properties of the getter due to a decrease in the amount of the active components.

The invention will be further described with reference to the following illustrative Examples.

DETAILED DESCRIPTION OF THE INVENTION

A number of non-evaporable getters with different component ratio according to the invention were manufactured as follows.

Molybdenum, tantalum and tungsten were used as the refractory metal.

A mixture of the components used in the form of powders was agitated for 30 minutes in a roller mill. From the resulting mixture a number of samples were manufactured by the conventional pressing technique on a hydraulic press, and their sorption properties were investigated after sintering in vacuum.

The investigation of the sorption properties was carried out using the technique of the constant volume by the sorption of air.

As a criterion of the evaluation of the sorption properties of the getters manufactured according to the invention served their total effective capacity in the temperature range from 20° C. to 500° C. and from 20° C. to 700° C. related to the active mass unit and measured in 1.μ/mg. The measurements were made at temperatures of 20° C., 100° C. and further on with an interval of 100° C. up to a temperature of 700° C. The time of exposure at each temperature amounted to 10 minutes.

The active sorption of all the samples under investigation started from a room temperature and increased with increasing temperature.

The evaluation of the sorption properties of the getter in the temperature range from 800° C. to 1000° C. was carried out by testing directly in electronic devices for an extended period of service (up to 5000 hours).

The samples were tested for their mechanical strength by applying static loads thereto. Vibration strength test of the samples was carried out in the devices placed on a shaker unit.

EXAMPLE 1

A mixture of the components in the form of powders containing 50 wt. % of titanium, 20 wt. % of titanium hydride and 30 wt. % of molybdenum was agitated on a roller mill for 30 minutes. From the resulting mixture following the conventional pressing technique (on a hydraulic press) a number of samples were manufactured whose weight amounted to 360±20 mg.

The samples were sintered in vacuum, whereupon they were tested for their sorption properties using the technique of the constant volume by the sorption of air in the temperature range from 20° to 700° C. with the exposure time at each temperature equal to 10 minutes.

The total effective capacity of the samples related to the mass unit at sorption temperatures from 20° C. to 500° C. amounted to 0.43+0.46 1.μ/mg, and at sorption temperatures from 20° C. to 700° C., to 1.1+1.2 1.μ/mg.

The sorption properties of the samples tested at the time of operation in electronic devices at temperatures from 800° C. to 1000° C. for 2000 to 5000 hours were evaluated by the residual sorption capacity using the constant volume technique. The sorption capacity of the samples extracted from different temperature zones of the device amounted to 50–85% of the original.

The samples withstood loads up to 200 kgf/cm$^2$ without damage and did not break down when tested for the vibrational survival capability in the range up to 2000 hz.

EXAMPLE 2

According to the technique stated in EXAMPLE 1, a number of samples with a weight of 240±20 mg were manufactured from a mixture of powders, containing 50 wt. % of titanium, 20 wt. % of titanium hydride, 20 wt. % of molybdenum and 10 wt. % of aluminum.

The sorption properties after sintering were investigated according to the technique stated in EXAMPLE 1.

The total effective capacity of the samples related to the mass unit at sorption temperatures from 20° C. to 500° C. amounted to 0.51+0.62 1.μ/mg, while at sorption temperatures from 20° C. to 700° C. to 1.38+1.49 1.μ/mg.

After testing in the devices for 2000–5000 hours at temperatures from 800° C. to 1000° C. the sorption capacity of the samples extracted from different temperature zones of the devices amounted to 50–85% of the original.

The samples withstood loads up to 200 kgf/cm$^2$ without damage and did not break down when tested for the vibration strength in the range up to 2000 hz.

In a table given hereinbelow presented are the compositions and data on the sorption and mechanical properties of the non-evaporable getters manufactured according to the proposed invention.

All the samples were manufactured and tested following the technique described in Example 1.

Thus, the proposed non-evaporable getters feature improved sorption and mechanical properties over a wide range of temperatures from 20° to 1000° C.

This allows to employ successfully the above-disclosed non-evaporable getters in a variety of devices of different classes and designations, such as receivingamplifying devices, oscillating and modulating tubes of various ratings, ultrahigh-frequency devices, devices with increased reliability and longevity requirements, cathoderay tubes, quartz resonators, extraminiature receivingamplifying devices, devices with hydrogen, inert gas or mercury fillings, lighting devices, monodisplay devices, X-ray transducers, radio-frequency mass-spectrometers, lazers, vidicons, getter pumps, gas-absorbing devices used in pumping facilities and so forth.

The proposed non-evaporable getters may be manufactured in any constructional shape such as: rings, bushings, plates, with lead-ins or without them, embedded in holders and press-fitted on holders, in the form of constructional elements in devices, in the form of coatings on bases or device elements and so forth.

The dimensions of the getter may be from 2 to 2.5 mm in diameter, while its weight may be from 3–4 mg to 3000 mg and more.

The non-evaporable getters manufactured according to the present invention allow to create composite constructions combining the evaporable and non-evaporable getters where the proposed non-evaporable getter serve as a holder for arranging the evaporation portion.

The application of the non-evaporable getters of the proposed compositions excludes explosion hazards and reduces fire hazards in the production processes involving their manufacture.

TABLE

Data of Investigations of Sorption and Mechanical Properties of Non-evaporable Getters of Different Compositions Manufactured According to the Invention

| | Composition, wt. % | | | | | Characteristics of non-evaporable getters | | | | |
|---|---|---|---|---|---|---|---|---|---|---|
| | | | | | | Sorption | | | Mechanical | |
| | | | | | | Total effective capacity $\left(\frac{1\mu}{mg}\right)$ | | | | |
| No. 1 | titanium 2 | metal 3 | titanium hydride 4 | aluminum 5 | Sample weight, mg 6 | at temp. 20° C.–500° C. 7 | at temp. 20° C.–700° C. 8 | Residual effective capacity after testing in devices, % 9 | Resistance to vibration loads, hz 10 | Resistance to static loads, kgf/cm$^2$ 11 |
| 1. | 50 | Mo 30 | 20 | — | 360 ± 20 | 0.43–0.46 | 1.10–1.21 | | | |
| 2. | 50 | Mo 20 | 20 | 10 | 240 ± 20 | 0.51–0.62 | 1.38–1.49 | | | |
| 3. | 98 | W 1.5 | 0.5 | — | 360 ± 20 | 0.49–0.51 | 1.03–1.13 | 50–85 | up to 2000 | up to 200 |
| 4. | 80 | Ta 10 | 10 | — | 360 ± 20 | 0.53–0.54 | 1.18–1.19 | | | |
| 5. | 93 | Ta 1.5 | 0.5 | 5 | 240 ± 20 | 0.58–0.60 | 1.36–1.39 | | | |
| 6. | 70 | Mo 5 | 5 | 20 | 240 ± 20 | 0.55–0.56 | 1.25–1.27 | | | |
| 7. | 70 | W 10 | 10 | 10 | 240 ± 20 | 0.53–0.57 | 1.29–1.34 | | | |

We claim:

1. A non-evaporable getter containing titanium, a refractory metal selected from Groups V and VI of the Periodic System with a melting temperature of no less than 2500° C. and titanium hydride, the ratio of the components taken in percent by weight being as follows:

titanium: 50 to 98
refractory metal: 1.5 to 30
titanium hydride: 0.5 to 20.

2. A non-evaporable getter as recited in claim 1 further containing aluminum, the ratio of the components taken in percent by weight being as follows:

titanium: 50 to 93
refractory metal: 1.5 to 20
titanium hydride: 0.5 to 20
aluminum: 5 to 20.

* * * * *